US011814866B2

(12) United States Patent
Hockenberry

(10) Patent No.: US 11,814,866 B2
(45) Date of Patent: Nov. 14, 2023

(54) PROTECTIVE POOL COVER ASSEMBLY

(71) Applicant: Aaron Hockenberry, Dayton, PA (US)

(72) Inventor: Aaron Hockenberry, Dayton, PA (US)

( * ) Notice: Subject to any disclaimer, the term of this patent is extended or adjusted under 35 U.S.C. 154(b) by 0 days.

(21) Appl. No.: 17/169,605

(22) Filed: Feb. 8, 2021

(65) Prior Publication Data

US 2021/0246676 A1 Aug. 12, 2021

Related U.S. Application Data

(60) Provisional application No. 62/972,705, filed on Feb. 11, 2020.

(51) Int. Cl.
*E04H 4/10* (2006.01)
*E04H 4/12* (2006.01)

(52) U.S. Cl.
CPC ..... *E04H 4/103* (2013.01); *E04H 4/129* (2013.01)

(58) Field of Classification Search
CPC ..... E04H 4/103–106; E04H 4/10–108
See application file for complete search history.

(56) References Cited

U.S. PATENT DOCUMENTS 3,533,110 A * 10/1970 Gisondi ..... E04H 4/103 4/499
3,608,099 A * 9/1971 Wall ..... E04H 4/105 4/503
3,801,994 A * 4/1974 Brown ..... E04H 4/103 4/499
3,813,704 A * 6/1974 Troiano ..... E04H 4/065 4/501
4,011,607 A * 3/1977 Davidoff ..... E04H 4/10 4/503
4,048,678 A * 9/1977 Chillino ..... E04H 4/105 4/503
4,136,408 A * 1/1979 Dahlbeck ..... E04H 15/02 52/63

(Continued)

FOREIGN PATENT DOCUMENTS

CA 2330518 * 7/2002 ..... E04H 4/10

OTHER PUBLICATIONS

Merriam-Webster. "Weighted". <https://www.merriam-webster.com/dictionary/weighted> (Year: 2009).*

*Primary Examiner* — David P Angwin
*Assistant Examiner* — Nicholas A Ros
(74) *Attorney, Agent, or Firm* — Brennan, Manna & Diamond, LLC

(57) ABSTRACT

A protective pool assembly for protecting a pool from external debris or contamination. The protective pool assembly comprises a flexible cover and a bladder. The flexible cover comprises a top layer configured to resist weather. The flexible cover is attached to or rests on and protects the bladder. The bladder rests on a bottom layer of the flexible cover, or directly on the surface of the water. The bladder is inflatable via an air valve to expand the bladder in a dome-like shape. The flexible cover is pushed upward into the dome-like shape so that external debris, rain, snow, and ice shed off of the flexible cover. A skirt extends from a perimeter of the flexible cover to further direct the debris or contaminates over the side of the pool. A plurality of securing elements are used to secure the protective pool assembly in place over the pool.

7 Claims, 7 Drawing Sheets

(56) References Cited

U.S. PATENT DOCUMENTS

| | | | | | |
|---|---|---|---|---|---|
| 4,606,083 | A * | 8/1986 | Kingston | E04H 4/103 | 4/504 |
| 4,790,037 | A * | 12/1988 | Phillips | E04H 4/105 | 4/499 |
| 4,847,925 | A * | 7/1989 | Perry | E04H 4/106 | 4/503 |
| 5,388,314 | A * | 2/1995 | Vella | E04H 4/10 | 4/503 |
| 6,286,157 | B1 * | 9/2001 | Baumann | E04H 4/103 | 4/503 |
| 8,069,504 | B1 * | 12/2011 | Greenfield, Jr. | E04H 4/105 | 4/503 |
| 8,201,285 | B1 * | 6/2012 | Pugliese | E04H 4/103 | 4/503 |
| 8,568,546 | B2 * | 10/2013 | Oropallo | E04H 4/106 | 156/64 |
| 9,353,540 | B2 * | 5/2016 | Jennings | E04H 4/103 | |
| 10,619,369 | B1 * | 4/2020 | Herd | E04H 4/103 | |
| 2009/0158517 | A1 * | 6/2009 | Herd | E04H 4/103 | 4/499 |
| 2010/0058529 | A1 * | 3/2010 | Decker | E04H 4/103 | 4/499 |
| 2012/0204339 | A1 * | 8/2012 | Geiger | E04H 4/103 | 4/499 |
| 2018/0313102 | A1 * | 11/2018 | Jackson, Jr. | E04H 4/103 | |
| 2019/0093377 | A1 * | 3/2019 | Jensen | B32B 27/08 | |
| 2019/0161986 | A1 * | 5/2019 | Huang | E04H 4/0025 | |

* cited by examiner

PROTECTIVE POOL COVER ASSEMBLY

CROSS-REFERENCE TO RELATED APPLICATION

The present application claims priority to, and the benefit of, U.S. Provisional Application No. 62/972,705, which was filed on Feb. 11, 2020 and is incorporated herein by reference in its entirety.

FIELD OF THE INVENTION

The present invention generally relates to a cover for a pool, and more specifically to a protective cover configured to keep debris out of the pool when in place. Accordingly, the present specification makes specific reference thereto. However, it is to be appreciated that aspects of the present invention are also equally amenable to other like applications, devices and methods of manufacture.

BACKGROUND OF THE INVENTION

A swimming pool is a structure designed to hold water to enable swimming or other water based leisure activities. Pools can be built into the ground, in-ground pools, or built above ground as a freestanding construction or as part of a building or other larger structure. Swimming pools are popular as an affordable luxury that enable many people to enjoy water based activities in the comport of their own homes. A hot tub or spa is a similar structure used to retain water for recreational purposes.

Taking care of a pool can be a frustrating, difficult and time consuming task. Pools require regular maintenance as they are easily contaminated. Swimming pool contaminants are introduced from environmental sources and swimmers. Environmental contaminants affecting outdoor swimming pools include windblown dirt and debris, incoming water from unsanitary sources, rain containing microscopic algae spores, and bird droppings that can harbor disease-causing pathogens. A well-maintained, properly operating pool filtration and re-circulation system is the first barrier in combating contaminants large enough to be filtered.

Filtration is a physical operation that separates solid matter and fluid from a mixture with a filter medium that has a complex structure through which only the fluid can pass. Solid particles that cannot pass through the filter medium are described as oversize. Oversize particles may form a filter cake on top of the filter and may also block the filter lattice, preventing the fluid phase from crossing the filter. The size of the largest particles that can successfully pass through a filter is called the effective pore size of that filter.

To properly filter or remove solid contaminates a swimming pool, there is a choice of manually cleaning the pool or using an automated pool cleaner. An automated pool cleaner is a vacuum-type cleaner that is designed to collect debris and sediment from the surface of swimming pools with minimal human intervention. Alternatively, a skimmer or a leaf net, along with an extendable telescoping pole, may be used to manually rake and collect the leaves and debris from a pool.

Pool covers provide a proactive way to protect a pool or hot tub from debris. Pool covers can also significantly decrease pool heating costs and reduce the amount of chemicals required by the pool. Outdoor pools gain heat from the sun, absorbing much of the solar energy striking the pool surface. Though a cover decreases the total amount of solar heat absorbed by the pool, the cover eliminates heat loss due to evaporation and reduces heat loss at night through its insulating properties. Most swimming pool heat loss is through evaporation. Unfortunately, debris commonly makes its way into pools despite covers or other physical barriers, During winter, snow and ice can weigh down these barriers and covers letting debris and rainwater enter and contaminate the water.

Therefore, there exists a long felt need in the art for an improved cover to protect a pool. There is also a long felt need for a device that saves extensive time and effort in maintaining a pool or a hot tub. Additionally, there is a long felt need in the art for a pool cover that can keep leaves, insects, dirt, rainwater, and other debris or contaminates out of a pool during nonuse. There is also a long felt need in the art for a pool cover that prevents the accumulation of snow and ice during the winter. Finally, there is a long felt need in the art for a pool cover that protects the pool water eliminating the need to manually skim or vacuum the pool.

In this manner, the improved protective pool cover of the present invention accomplishes all of the forgoing objectives, thereby providing an easy solution keeping a pool or hot tub clean from debris. A primary feature of the present invention is a pool cover configured to avoid the buildup of snow and ice during the winter. Finally, the improved protective pool cover of the present invention is capable of keeping external debris and contaminates out of the pool by diverting the debris and contaminates away from the pool.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises a protective cover assembly. The protective cover assembly is configured to protect a pool and is removably positional across a top surface of the pool. The protective cover assembly comprises a flexible cover and a bladder. The bladder is positional beneath the flexible cover and may be attached to a center of the flexible cover.

The flexible cover comprises a skirt portion. The skirt portion of the cover rings and encircles the flexible cover and is configured to extend beyond a perimeter of the pool when the protective cover assembly is in place over the pool. The skirt portion terminates in a perimeter of the flexible cover and is not attached to the bladder. The flexible cover may further comprise a weighted member. The weighted member is embedded within and extends around the perimeter of the flexible cover.

The bladder comprises a base and a curved top extending from the base to define an expandable interior volume. The bladder is dome-shaped once inflated. The base is adapted to cover a surface of the pool and fit within a sidewall of the pool when the bladder is inflated. The bladder further comprises a valve for inflating and deflating the bladder. The valve penetrates the flexible cover.

The protective cover assembly further comprises a plurality of securing elements. The plurality of securing elements are attached to the perimeter of the flexible cover. The plurality of securing elements are configured to engage the sidewall of the pool to keep the protective cover assembly in place. The protective cover assembly further comprises an inflating component. The inflating component is adapted to engage the valve and to inflate the bladder.

The subject matter disclosed and claimed herein, in another embodiment thereof, comprises a protective cover assembly. The protective cover assembly is configured to protect a pool and is removably positional across a top surface of the pool. The protective cover assembly comprises a flexible cover and a bladder. The bladder is positional within the flexible cover and may freely float within or be attached to the flexible cover.

The flexible cover comprises a top layer and a bottom layer. The top and bottom layers are attached along a perimeter. The protective cover assembly further comprises a skirt. The skirt rings the flexible cover and is configured to extend beyond a perimeter of the pool when the protective cover assembly is in place over the pool. The skirt portion attaches to and extends from the top layer of the flexible cover along a skirt attachment perimeter. The skirt attachment perimeter is smaller in diameter than the perimeter of the flexible cover. The skirt may comprise a weighted member. The weighted member is embedded within and extends around an outer edge of the skirt.

The bladder comprises a base and a curved top extending from the base to define an expandable interior volume. The bladder is encapsulated within the top and bottom layers of the flexible cover. The bladder is dome-shaped once inflated. The base is adapted to cover a surface of the pool and fit within a sidewall of the pool when the bladder is inflated. The bladder further comprises a valve for inflating and deflating the bladder. The valve penetrates the flexible cover.

The protective cover assembly further comprises a plurality of securing elements. The plurality of securing elements are attached to the perimeter of the flexible cover. The plurality of securing elements are configured to engage the sidewall of the pool to keep the protective cover assembly in place. The protective cover assembly further comprises an inflating component. The inflating component is adapted to engage the valve and to inflate the bladder.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
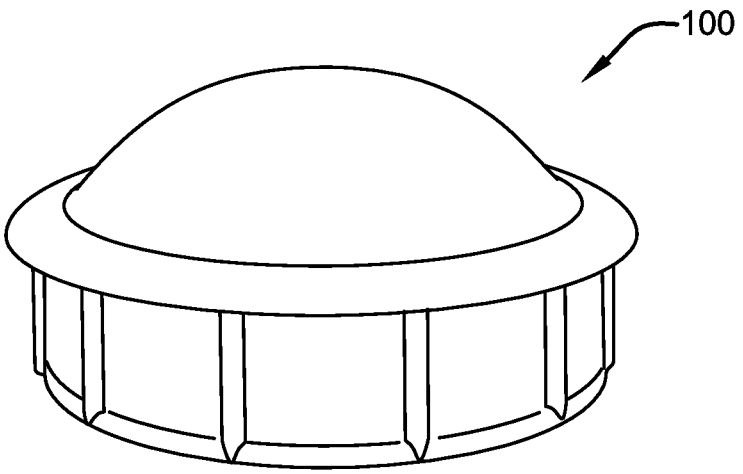
FIG. 1 illustrates a perspective view of one embodiment of a protective cover assembly of the present invention covering a pool in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They do not intend as an exhaustive description of the invention or do not limit the scope of the invention. Additionally, an illustrated embodiment need not have all the aspects or advantages shown. Thus, in other embodiments, any of the features described herein from different embodiments may be combined.

The present invention, in one exemplary embodiment, is a protective cover for a pool or hot tub. The pool cover utilizes a bladder to inflate a cover creating a dome like structure over the water surface. The dome-style cover is attachable to in ground or above ground pools. The cover is inflatable creating the dome shape which prevents debris from accumulating on the cover or dirtying the protected water. The cover is attachable to a perimeter of the pool via several clasp mechanisms or other fasteners. The bladder can be connected to the center of the cover, delivering air under the cover and inflating it over the water surface. Debris is director or diverted off of the cover onto the ground and away from the pool. Users can maintain a clean pool with ease, prevented from having to skim the water surface or use a pool vacuum.

Figure 7:
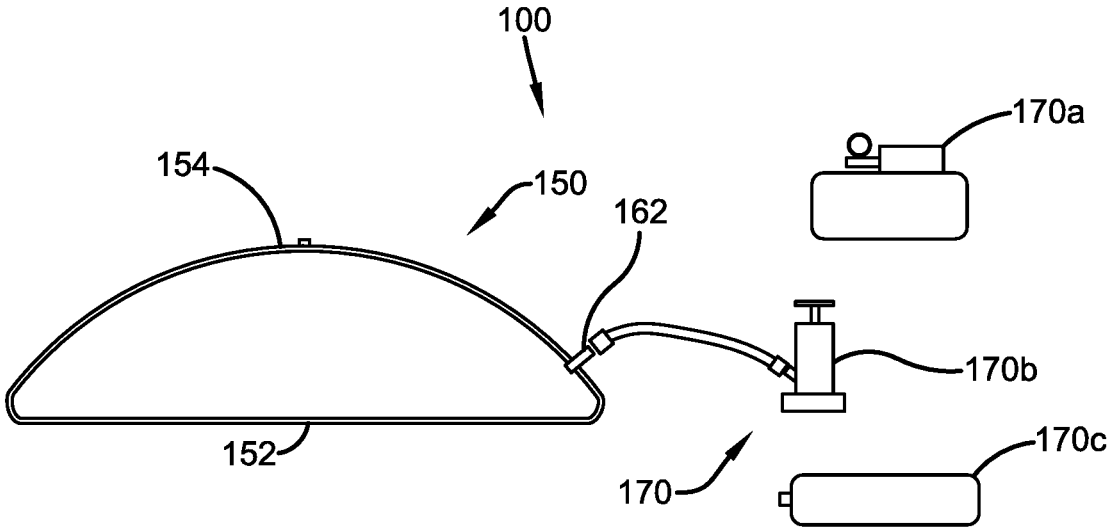
FIG. 7 illustrates a side view of the bladder and an inflating component the protective cover assembly of the present invention in accordance with the disclosed architecture.
Figure 8:
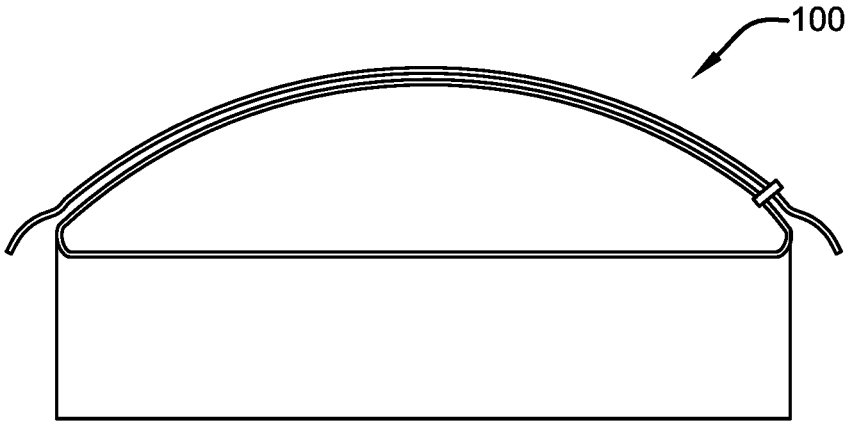
FIG. 8 illustrates a side cutaway view of the protective cover assembly of the present invention in accordance with the disclosed architecture.

Referring initially to the drawings, FIGS. 1-9 illustrate a protective cover assembly 100. The protective cover assembly 100 is configured to protect a pool from external debris or contamination. The protective cover assembly 100 is adaptable to protect above ground or in ground pools, hot tubs, manufactured garden ponds, or the like. The protective cover assembly 100 is typically circular for protecting round pools but may be constructed in a rectangular or oval configuration, as illustrated in FIG. 8, to protect differently shaped pools.

Figure 2:
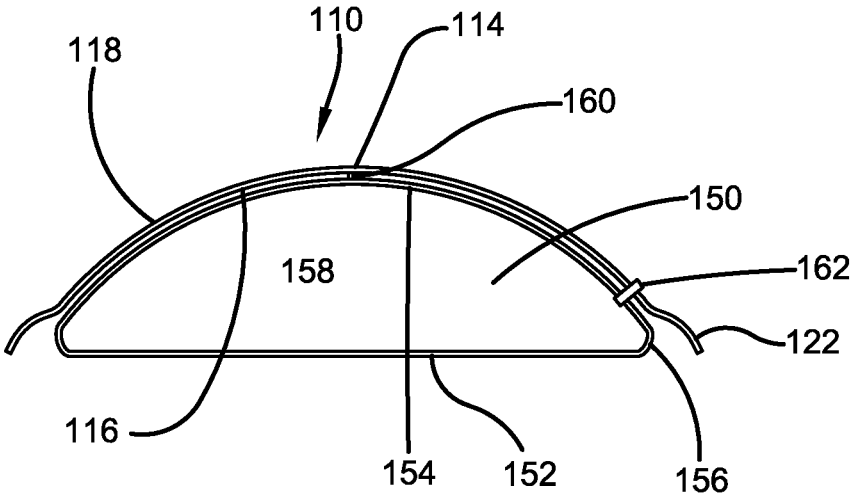
FIG. 2 illustrates a side cutaway view of the protective cover assembly of the present invention covering a pool in accordance with the disclosed architecture.
Figure 3:
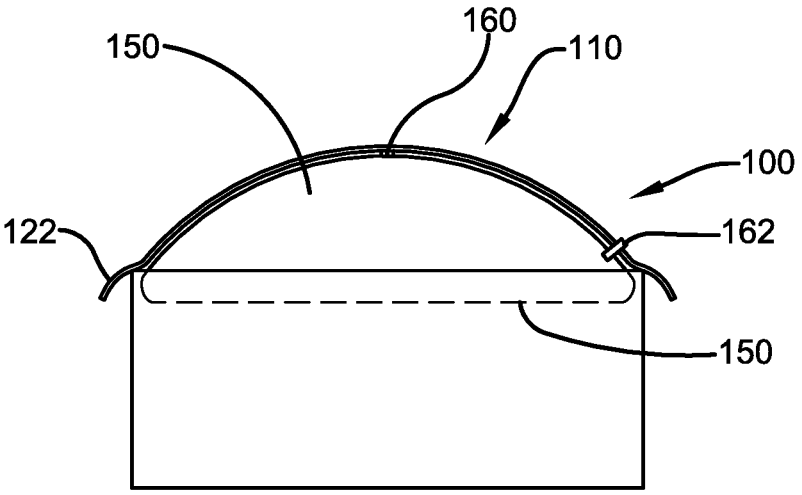
FIG. 3 illustrates a side cutaway view of the protective cover assembly of the present invention in accordance with the disclosed architecture.
Figure 5:
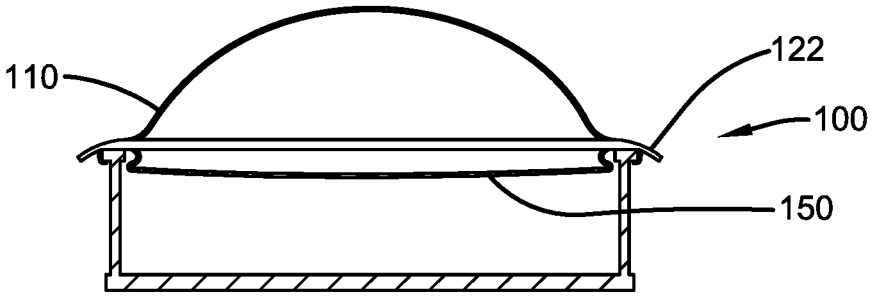
FIG. 5 illustrates a side cutaway view of the protective cover assembly of the present invention covering the pool in accordance with the disclosed architecture.
Figure 6:
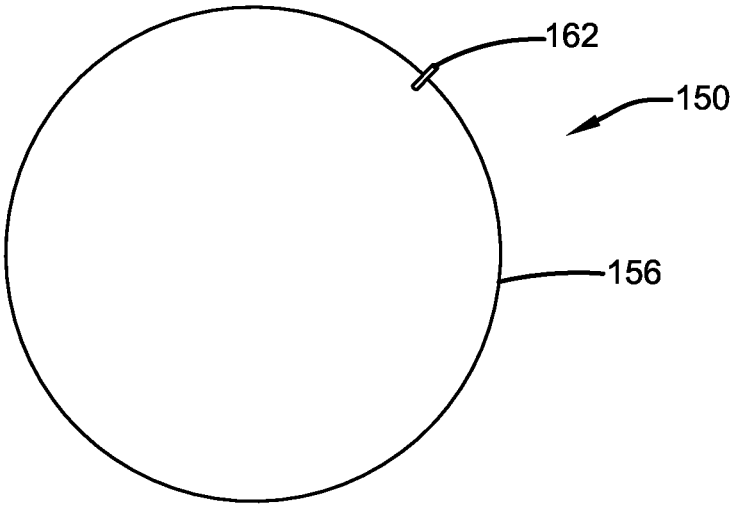
FIG. 6 illustrates an overhead view of a bladder of the protective cover assembly of the present invention in accordance with the disclosed architecture.

As illustrated in FIGS. 2, 3, and 5, the protective cover assembly 100 comprises a flexible cover 110 and a bladder 150. The bladder 150 is positional beneath the flexible cover 110 and may be attached to a center 114 of the flexible cover 110 or anywhere else along the flexible cover 110. The flexible cover 110 is constructed from a durable, flexible, and weather resistant material and is configured to expand and contract. For example, the flexible cover 110 may be manufactured from a rubber innertube material with a waterproof material on top. The flexible cover 110 comprises an inner surface 116 and an outer surface 118. The outer surface 118 may be coated with a weatherproofing coating and may be colored to reflect or absorb heat.

Figure 4:
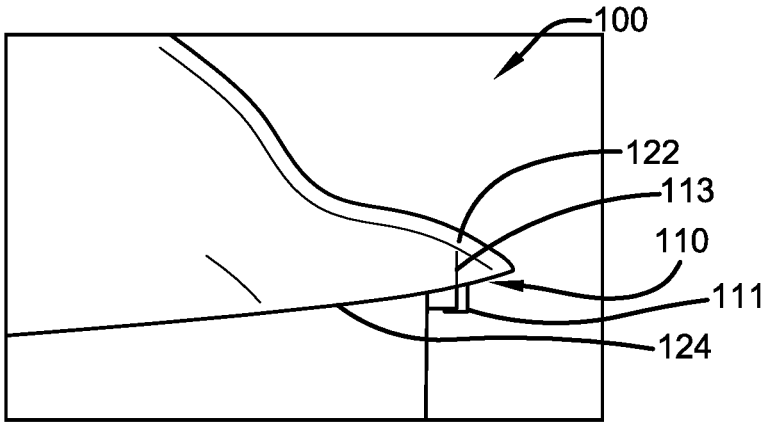
FIG. 4 illustrates a closeup perspective view of a flexible cover of the protective cover assembly of the present invention in accordance with the disclosed architecture.
Figure 9:
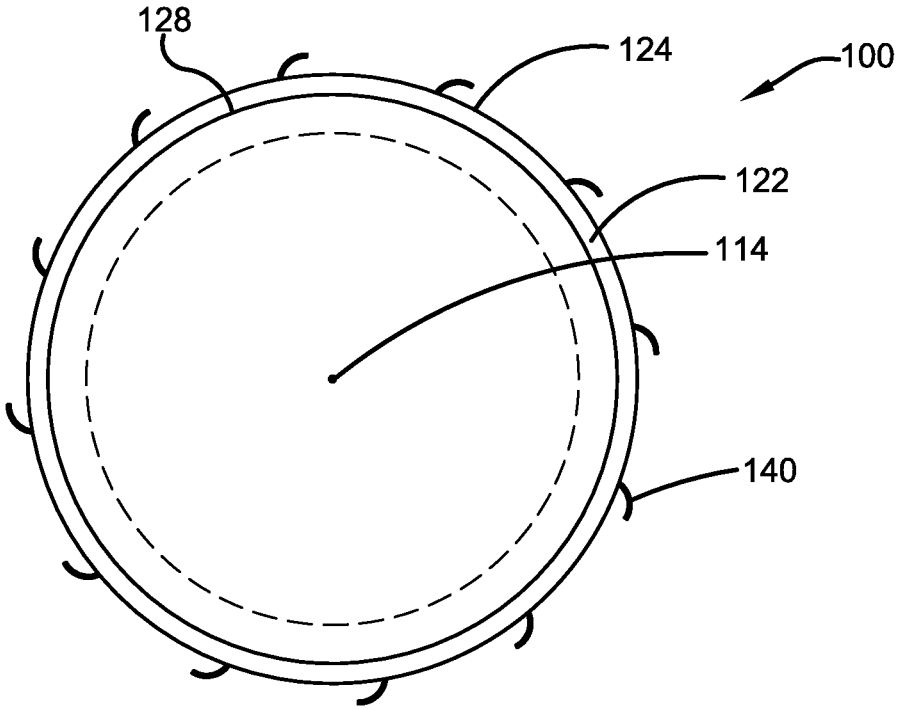
FIG. 9 illustrates an overhead view of the protective cover assembly of the present invention in accordance with the disclosed architecture.
Figure 10:
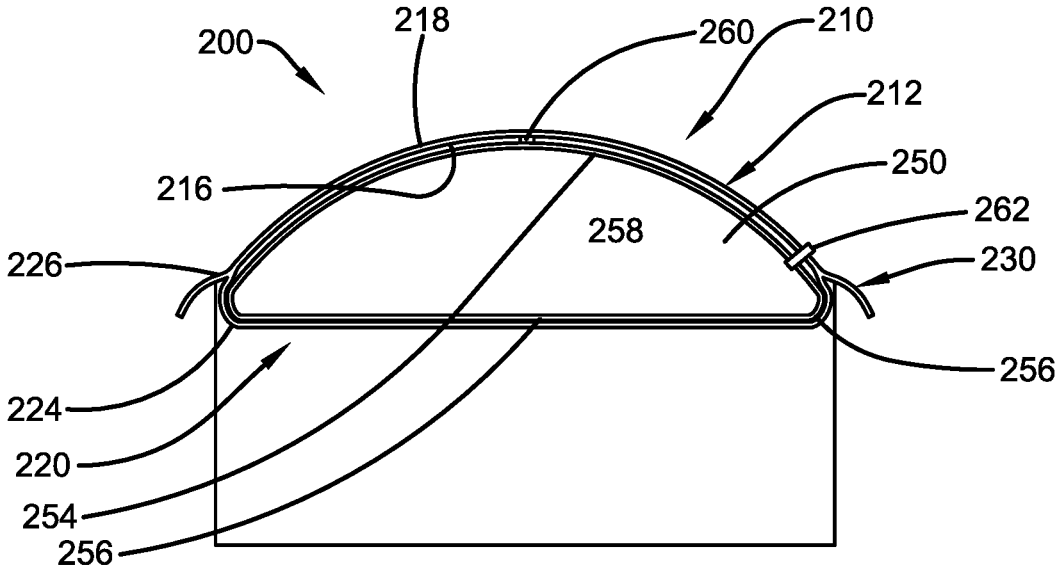
FIG. 10 illustrates a side cutaway view of one embodiment of a protective cover assembly of the present invention covering a pool in accordance with the disclosed architecture.
Figure 11:
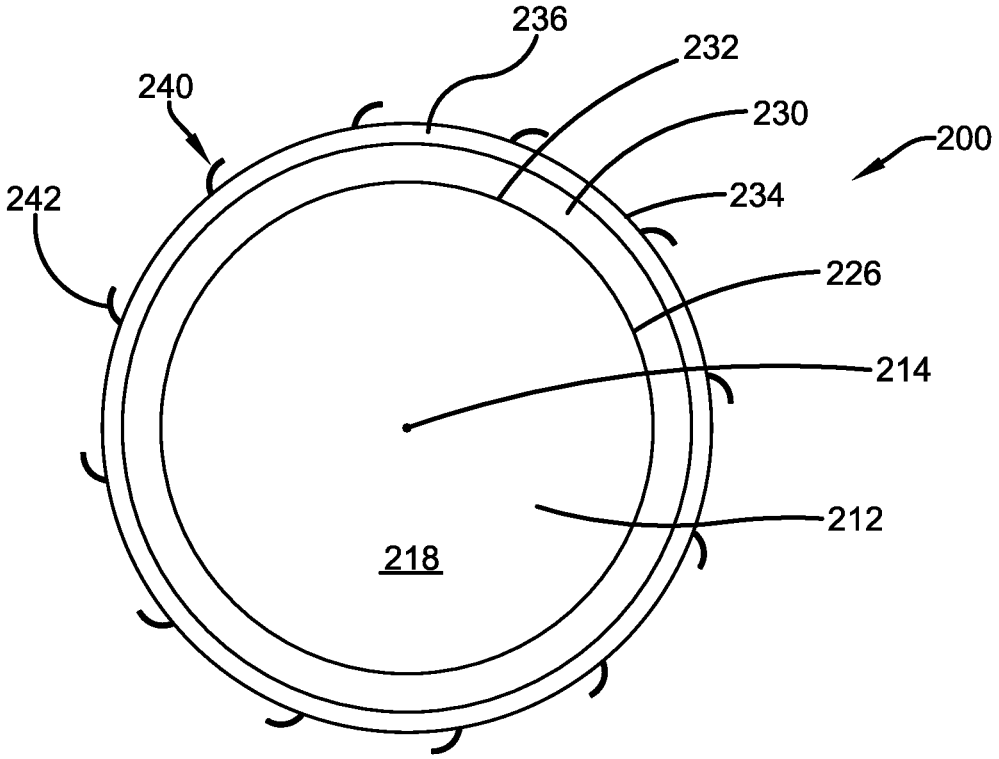
FIG. 11 illustrates an overhead view of the protective cover assembly of the present invention in accordance with the disclosed architecture.

As illustrated in FIGS. 2-4, the flexible cover 110 further comprises a skirt portion 122. The skirt portion 122 rings or encircles the flexible cover 110 and is configured to extend beyond a perimeter of the pool when the protective cover assembly 100 is inflated in place over the pool. The skirt portion 122 terminates in a perimeter 124 of the flexible cover 110 and is not attached to the bladder 150. As illustrated in FIG. 9, the flexible cover 110 may further comprise a weighted member 128. The weighted member 128 may be attached to or embedded within the flexible cover 110. The weighted member 128 extends around the perimeter 124 of the flexible cover 110 to keep it in place over the pool. The skirt portion 122 itself may be weighted or heavier than the rest of the flexible cover 110.

As illustrated in FIGS. 2, 3 and 5-7, the bladder 150 comprises a base 152 and a domed top 154 extending from the base 152. The base 152 and domed top 154 define an expandable interior volume 158. The bladder 150 is dome-shaped once inflated. The base 152 is adapted to cover a surface of the pool with a perimeter 156 of the bladder 150 fitting within a sidewall of the pool when the bladder 150 is inflated. The domed top 154 then extends upward to create a curved surface for shedding debris. A cover attachment point 160 may attach to the center 114 of the flexible cover 110. The bladder 150 further comprises a valve 162 for inflating and deflating the bladder 150. The valve 162 may be a one-way air valve that penetrates the flexible cover 110 near the skirt portion 122 for easy access.

As illustrated in FIG. 9, the protective cover assembly 100 further comprises a plurality of securing elements 140. The plurality of securing elements 140 are attached to the perimeter 124 of the flexible cover 110. The plurality of securing elements 140 are configured to engage the sidewall of the pool to keep the protective cover assembly 100 in place. The plurality of securing elements 140 may be clasps, ties, hook and loop fasteners, loops, or any other type of mechanical attachment as is known in the art. For example, a foot 111 attached to the perimeter 124 could be configured to interlock underneath a pool railing 113 as illustrated in FIG. 4. Alternatively, a weight attached to a cord may be used to keep the protective cover 100 in place.

As illustrated in FIG. 7, the protective cover assembly 100 may further comprise an inflating component 170. The inflating component 170 is adapted to engage the valve 162 and to inflate the bladder 150. The inflating component 170 may be an air compressor 170A, a hand pump 170B, or a compressed gas cylinder 170C. Alternatively, a shop vacuum configured as a blower may be used as well.

The subject matter disclosed and claimed herein, in another embodiment thereof as illustrated in FIGS. 10-13, comprises a protective cover assembly 200. The protective cover assembly 200 is configured to protect a pool and is removably positional across a top surface of the pool. The protective cover assembly 200 is dome-shaped when inflated. The protective cover assembly 200 comprises a flexible cover 210 and a bladder 250. The bladder 250 is positional within the flexible cover 210. The flexible cover 210 comprises a top layer 212 and a bottom layer 220. The top 212 and bottom 220 layers are attached along a perimeter 224. The top layer 212 comprises an inner surface 216 and an outer surface 218. The outer surface 218 may be coated with a weatherproofing coating and may be colored to reflect or absorb heat.

The protective cover assembly 200 further comprises a skirt 230. The skirt 230 rings the flexible cover 210 and is configured to extend beyond a perimeter of the pool when the protective cover assembly 200 is in place over the pool. A cover attachment edge 232 of the skirt 230 attaches to and extends from the top layer 212 of the flexible cover 210 along a skirt attachment perimeter 226. The skirt attachment perimeter 226 is smaller in diameter than the perimeter of the flexible cover 224. The skirt 230 may comprise a weighted element 236. The weighted element 236 may be attached to or embedded within the skirt 230 along an outer edge 234 of the skirt 230. Alternatively, the skirt 230 itself may be weighted or heavier than the rest of the flexible cover 210.

Figure 13:
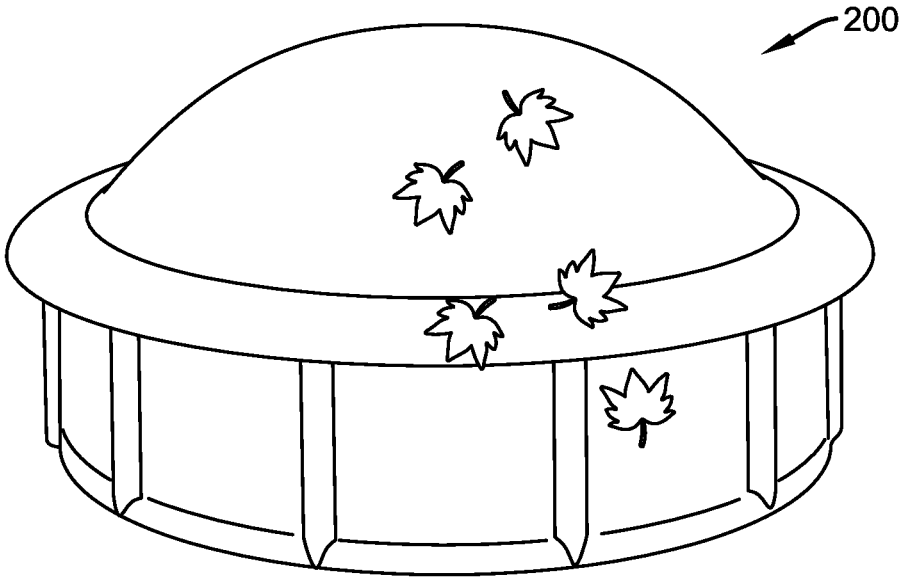
FIG. 13 illustrates a perspective view of the protective cover assembly of the present invention covering and preventing debris from entering the pool in accordance with the disclosed architecture.

The bladder 250 comprises a base 252 and a domed top 254 extending from the base 252. The base 252 and domed top 254 define an expandable interior volume 258. The bladder 250 is dome-shaped once inflated. The base 252 is adapted to cover a surface of the pool with a perimeter 256 of the bladder 250 fitting within a sidewall of the pool when the bladder 250 is inflated. The domed top 254 then extends upward to create a curved surface for shedding debris as illustrated in FIG. 13. A cover attachment point 260 may attach to the center 214 of the top layer 212 of the flexible cover 210. The bladder 250 further comprises a valve 262 for inflating and deflating the bladder 230. The valve 262 may be a one-way air valve that penetrates the flexible cover 210 near the skirt 230 for easy access.

Figure 12:
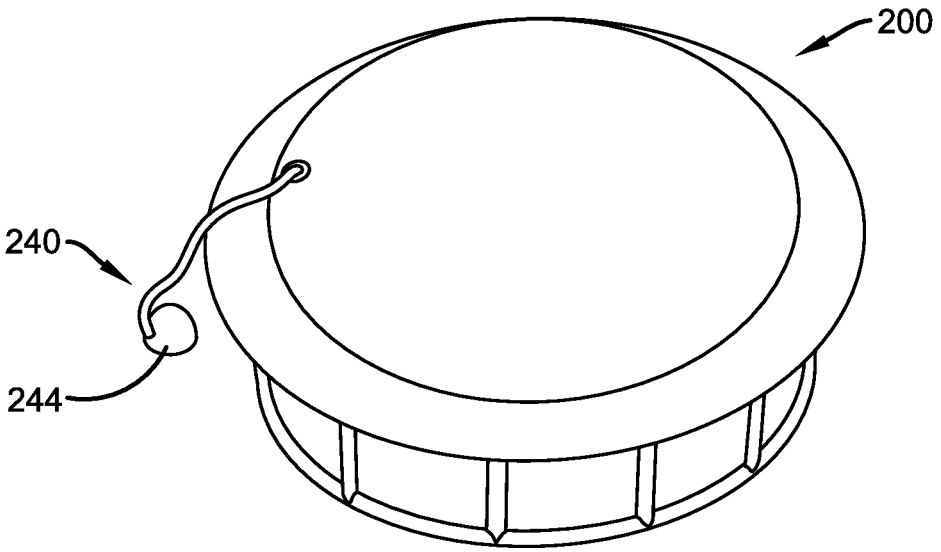
FIG. 12 illustrates an overhead perspective view of the protective cover assembly of the present invention covering the pool in accordance with the disclosed architecture.

The protective cover assembly 200 further comprises a plurality of securing elements 240. The plurality of securing elements 240 are attached to the perimeter 224 of the flexible cover 210. The plurality of securing elements 240 are configured to engage the sidewall of the pool to keep the protective cover assembly 200 in place. The plurality of securing elements 240 may be clasps, ties, hook and loop fasteners, loops, or any other type of mechanical attachment as is known in the art. Alternatively, a weight attached to a cord 244 may be used to keep the protective cover 200 in place as illustrated in FIG. 12.

The protective cover assembly 200 may further comprise an inflating component 270. The inflating component 270 is adapted to engage the valve 262 and to inflate the bladder 250. The inflating component 270 may be an air compressor (similar to 170A), a hand pump (similar to 170B), or a compressed gas cylinder (similar to 170C).

Notwithstanding the forgoing, the protective pool assemblies 100 and 200 can by any suitable size, shape, and configuration as is known in the art without affecting the overall concept of the invention, provided that it accomplishes the above stated objectives. One of ordinary skill in the art will appreciate that the shape and size of the protective pool assemblies 100 and 200 and its various components, as show in the FIGS. are for illustrative purposes only, and that many other shapes and sizes of the protective pool assemblies 100 and 200 are well within the scope of the present disclosure. Although dimensions of the protective pool assemblies 100 and 200 and its components (i.e., length, width, and height) are important design parameters for good performance, the protective pool assemblies 100 and 200 and its various components may be any shape or size that ensures optimal performance during use and/or that suits user need and/or preference. As such, the protective pool assemblies 100 and 200 may be comprised of sizing/shaping that is appropriate and specific in regard to whatever shaped pools the protective pool assemblies 100 and 200 are designed to be applied.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A protective cover assembly for protecting a pool comprising:

a flexible cover configured to expand and contract comprising a weighted skirt portion and a weighted member embedded within and extending around a perimeter of the flexible cover;

a bladder completely positional beneath the flexible cover; and a plurality of securing hook and loop fasteners attached to a perimeter of the flexible cover configured to engage a sidewall of the pool; and wherein the bladder is adapted to cover a surface of the pool when inflated and the flexible cover extends beyond a perimeter of the pool; and wherein the perimeter of the flexible cover is configured to interlock underneath a pool railing of the pool to further secure the protective cover to the pool.

2. The protective cover assembly of claim 1, wherein the bladder is dome-shaped when inflated.

3. The protective cover assembly of claim 1 further comprising an inflating component for inflating the bladder.

4. The protective cover assembly of claim 3, wherein the inflating component is a compressed gas cylinder.

5. A dome-shaped protective cover assembly removably positional across a top surface of a pool, the protective pool cover comprising:

a flexible cover configured to expand and contract comprising a skirt portion that is heavier than a rest of the flexible cover and a weighted member embedded within and extending around a perimeter of the flexible cover;

a bladder comprising a base and a domed top extending from the base, the bladder completely positional beneath the flexible cover and attached to a center of an inner surface of the flexible cover via a cover attachment point; and a plurality of securing elements attached to a perimeter of the flexible cover;

a shop vacuum; and wherein the base of the bladder is adapted to cover the top surface of the pool when inflated and the skirt portion of the flexible cover extends beyond a perimeter of the pool; and wherein an outer surface of the flexible cover is coated with a weatherproof reflective coating; and wherein the plurality of securing elements are hook and loop fasteners configured to engage a sidewall of the pool; and wherein the bladder is inflatable using the shop vacuum configured as a blower; and wherein the perimeter of the flexible cover is configured to interlock underneath a pool railing of the pool to further secure the protective cover to the pool.

6. The protective cover assembly of claim 5, wherein the bladder comprises a one-way valve.

7. The protective cover assembly of claim 5, wherein the skirt portion of the flexible cover is not attached to the bladder.

* * * * *